US008568048B2

(12) United States Patent
Chan

(10) Patent No.: US 8,568,048 B2
(45) Date of Patent: Oct. 29, 2013

(54) BENDABLE MASCARA BRUSH

(75) Inventor: Li-Chun Chan, Taichung (TW)

(73) Assignee: Shya Hsin Plastic Works Co., Ltd., Taichung (TW)

( * ) Notice: Subject to any disclaimer, the term of this patent is extended or adjusted under 35 U.S.C. 154(b) by 346 days.

(21) Appl. No.: 13/018,368

(22) Filed: Jan. 31, 2011

(65) Prior Publication Data

US 2012/0195672 A1 Aug. 2, 2012

(51) Int. Cl.
*A46B 11/00* (2006.01)

(52) U.S. Cl.
USPC ..... 401/127; 401/126

(58) Field of Classification Search
USPC ..... 401/126, 127, 129, 130
See application file for complete search history.

(56) References Cited

U.S. PATENT DOCUMENTS

| | | | | |
|---|---|---|---|---|
| 4,428,388 | A * | 1/1984 | Cassai et al. | 132/218 |
| 5,328,282 | A * | 7/1994 | Charrier et al. | 401/4 |
| 6,309,125 | B1 * | 10/2001 | Peters | 401/127 |
| 7,429,141 | B2 * | 9/2008 | Habatjou | 401/127 |

* cited by examiner

*Primary Examiner* — David Walczak
(74) *Attorney, Agent, or Firm* — Leong C. Lei

(57) ABSTRACT

A bendable mascara brush which includes a container for storing mascara and a brush assembly plugging into the container. The brush assembly form a joint between a brush shaft and a main shaft. Then, a slant guiding surface is configured in front of the brush shaft and, as the brush shaft is pushed forward by the main shaft, a slant surface of the brush shaft engages the guiding surface, causing the brush shaft to tilt to a side at an angle and thereby avoiding the problem of blocking user view. Additionally, a notch is configured opposite to the guiding surface so that the tilted brush shaft is embedded into the notch and held reliably and steadily in its tilted configuration.

4 Claims, 3 Drawing Sheets

BENDABLE MASCARA BRUSH

TECHNICAL FIELD OF THE INVENTION

The present invention is generally related to mascara brushes, and more particularly to a mascara brush where the brush is automatically tilted for improved convenience of usage.

DESCRIPTION OF THE PRIOR ART

Most conventional mascara brushes have bristles on a straight shaft. When put to use in front of a mirror, even when using the mascara brush for someone else, the straight shaft often blocks the view of the user, causing great inconvenience.

SUMMARY OF THE INVENTION

To obviate the foregoing shortcoming, the present invention teaches a mascara brush that is automatically bended or tilted to a side when put to use and automatically restored to a straight configuration after usage. The gist of the present invention is to form a joint between a brush shaft and a main shaft. Then, a slant guiding surface is configured in front of the brush shaft and, as the brush shaft is pushed forward by the main shaft, a slant surface of the brush shaft engages the guiding surface, causing the brush shaft to tilt to a side at an angle. As such, the conventional mascara brush's disadvantage of blocking user view is avoided.

Additionally, a notch is configured opposite to the guiding surface so as to receive the tilted brush shaft. When the slant surface of the brush shaft engages the guiding surface and the brush shaft is tilted to a side, the brush shaft is embedded into the notch so that the brush shaft is held reliably and steadily in its tilted configuration. As such, the tilted brush shaft does not vibrate or shatter during usage, greatly enhancing the usability of the mascara brush of the present invention.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
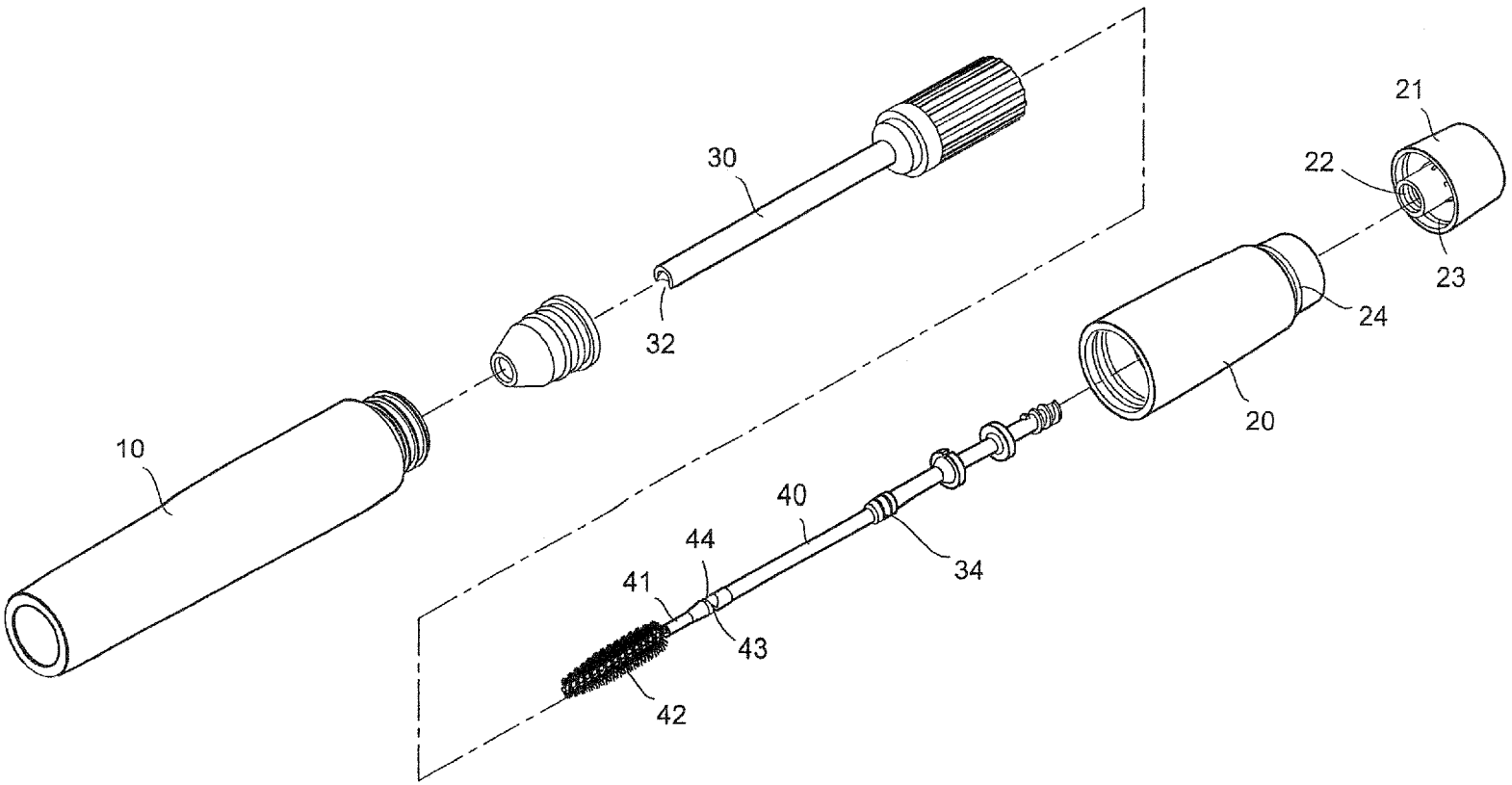
FIG. 1 is a perspective break-down diagram of a bendable mascara brush according to an embodiment of the present invention.
Figure 2:
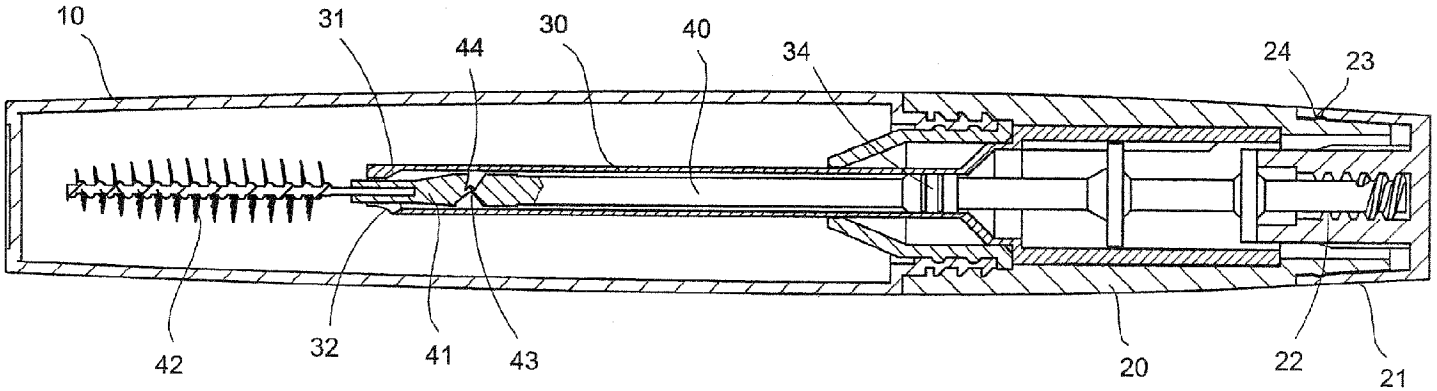
FIG. 2 is a schematic sectional diagram showing the internal of the bendable mascara brush of FIG. 1.
Figure 3:
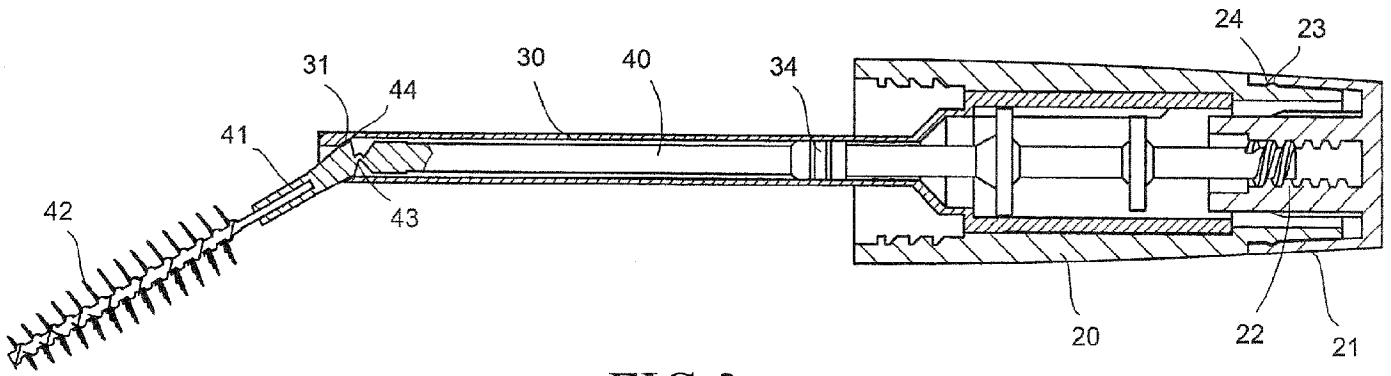
FIG. 3 is a schematic sectional diagram showing the internal of the bendable mascara brush of FIG. 1 when a brush shaft is tilted.

As shown in FIGS. 1 to 3, a mascara brush according to an embodiment of the present invention includes a container 10 where mascara is stored, and a brush assembly that could be fastened to and concealed inside the container 10. The brush assembly contains a main shaft 40 having a front end joined to a brush shaft 41 with sequential rings of bristles 42 radially spread out. Aback end of the main shaft is joined to an adjustment element 22 inside an adjustment cap 21. The adjustment element 22 could be as simple as a tube with internal threads. It could be fixed to the adjustment cap 21 separately or integrally formed with the adjustment cap 21. By twisting the adjustment cap 21, the adjustment element 22 as well as the main shaft 40 is turned simultaneously. The brush assembly also contains a tubular sleeve 30 jointed to a barrel 20. The main shaft 40 is threaded through the barrel 20 and the tubular sleeve 30 so that the adjustment cap 21 interfaces with a back end of the barrel 20. On the interfaces where the adjustment cap 21 is joined to the barrel 20, corresponding dots 24 and positioning groove 23 engage with each other for rotatably locking the adjustment cap 21 and the barrel 20 together. Alternatively, elastic fastening element together with periodic teeth along the interfaces could achieve step-wise adjustment. Additionally, a bendable joint 43 is formed between the main shaft 40 and brush shaft 41. To form the bendable joint 43, a back end of the brush shaft 41 is configured with a slant surface 44 whose slope is matched with a slant guiding surface 31 inside and adjacent to a front opening of the tubular sleeve 30. As such, when the brush shaft 41 is driven out of the tubular sleeve 30 by the main shaft 40, the guiding surface 31 forces the brush shaft 41 to tilt to a side. Opposite to the guiding surface 31, a notch 32 is configured also inside and adjacent to the front opening of the tubular sleeve 30. When the brush shaft 41 is tilted to a side as the slant surface 44 and the guiding surface 31 press against each other, the brush shaft 41 is further supported by the notch 32 so that the brush shaft 41 is reliably and steadily held in its tilted configuration. When the mascara brush is in use, the brush shaft 41 therefore does not vibrate or shatter for convenient usage.

To use the mascara brush, the adjustment cap 21 is twisted and, through the adjustment element 22, the main shaft 40 is extended toward the front opening of the tubular sleeve 30. As the main shaft 40 is extended, the brush shaft 41 is driven out of the tubular sleeve 30. As the joint 43 reaches the guiding surface 31 and the slant surface 44 follows the guiding surface 31, the brush shaft 41 is tilted to a side and falls into the notch 32. The brush shaft 41 is therefore reliably held in this tilted configuration. After usage, the adjustment cap 21 is twisted in an opposite direction and the main shaft 40 is retracted. The brush shaft 41 then returns back into the barrel 20. Finally, the brush assembly is plugged into the container 10 and fastened.

Figure 4:
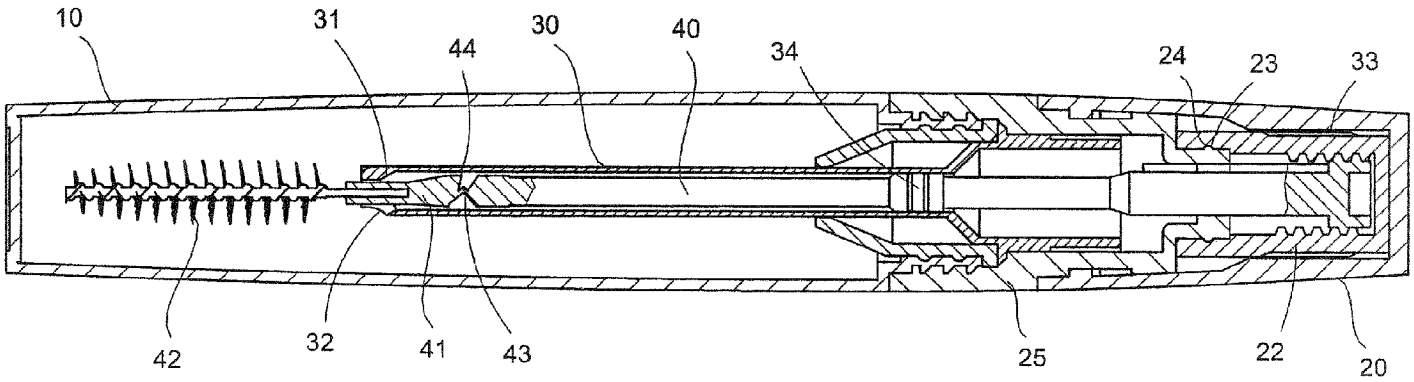
FIG. 4 is a schematic sectional diagram showing a fastening mechanism for a mascara brush according to an alternative embodiment of the present invention.
Figure 5:
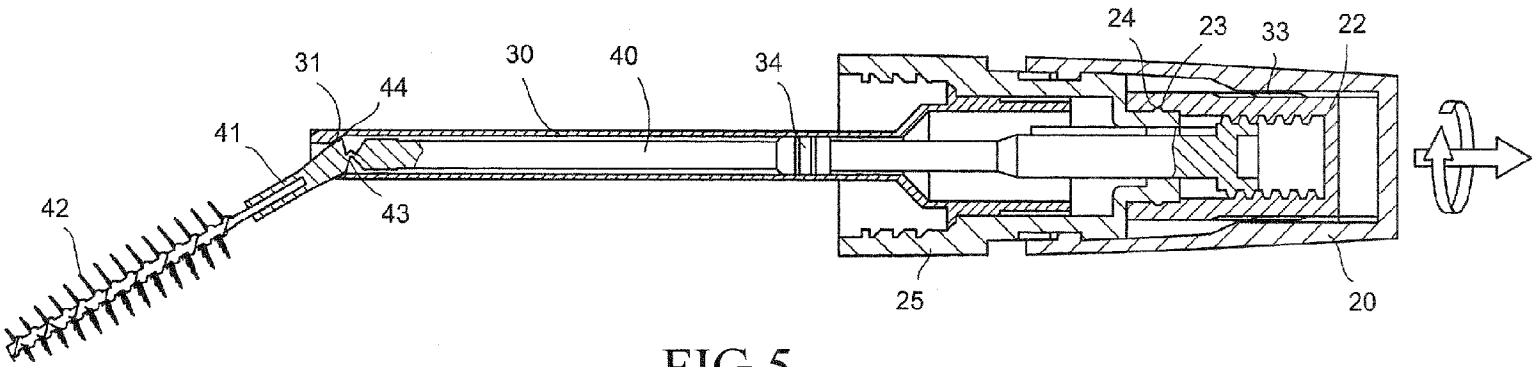
FIG. 5 is a schematic sectional diagram showing the internal of the bendable mascara brush of FIG. 4 when a brush shaft is tilted.

In an alternative embodiment as shown in FIGS. 4 and 5 to avoid that the adjustment cap 21 is mistakenly twisted, the adjustment element 22 is directly configured inside the barrel 20 and a fastening element 25 is configured in a front section of the barrel 20 where the tubular sleeve 30 is fixedly joined. In addition, the circumference of the adjustment element 22 is configured with a fastening surface 33 with periodically configured circular ribs or grooves of an appropriate distance. As such, when the brush assembly is plugged into the container 10, the fastening surface 33 enhances the stability of connection between the barrel 20 and the container 10. On the other hand, to use the mascara brush, the barrel 20 is pulled to escape the confinement of the fastening surface 33 and the barrel 20 could be twisted and, through the adjustment element 22, the main shaft 40 is extended toward the front opening of the tubular sleeve 30. As the main shaft 40 is extended, the brush shaft 41 is driven out of the tubular sleeve 30. As the joint 43 reaches the guiding surface 31 and the slant surface 44 follows the guiding surface 31, the brush shaft 41 is tilted to a side and falls into the notch 32. The brush shaft 41 is therefore reliably held in this tilted configuration. After usage, the barrel 20 is twisted in an opposite direction and the main shaft 40 is retracted. The brush shaft 41 then returns back into the barrel 20. Finally, the brush assembly is plugged into the container 10 and fastened. On the interfaces where said fastening element 25 is joined to said barrel 20, corresponding dots and positioning groove engage with each other for rotatably locking said fastening element 25 and said barrel 20 together.

Optionally, one or more ribs 34 are configured around the main shaft 40 so that the main shaft 40 interfaces tightly against the inner wall of the tubular sleeve 30. The ribs 34 prevent the mascara from leaking and ensure steady, smooth, and noiseless extension of the main shaft 40 along the tubular sleeve 30.

While certain novel features of this invention have been shown and described and are pointed out in the annexed claim, it is not intended, to be limited to the details above, since it will be understood that various omissions, modifications, substitutions and changes in the forms and details of the device illustrated and in its operation can be made by those skilled in the art without departing in any way from the spirit of the present invention.

I claim:

1. A bendable mascara brush, comprising:

a container adapted to store mascara; and a brush assembly fastened to and partially concealed inside said container, said brush assembly comprising a tubular sleeve, a main shaft, a brush shaft, a barrel, an adjustment element, and an adjustment cap;

wherein said adjustment element is a tube with internal threads;

said brush shaft has sequential rings of bristles radially spread out;

said main shaft has a front end joined to said brush shaft and a back end joined to said adjustment element inside said adjustment cap;

said tubular sleeve is jointed to said barrel;

said main shaft is threaded through said barrel and said tubular sleeve so that said adjustment cap interfaces with a back end of said barrel;

a bendable joint is formed between said main shaft and said brush shaft, a back end of said brush shaft being configured with a slant surface whose slope is matched with a slant guiding surface inside and adjacent to a front opening of said tubular sleeve;

opposite to said slant guiding surface, a notch is configured inside and adjacent to said front opening of said tubular sleeve;

and when said brush shaft is driven out of said tubular sleeve by said main shaft as said adjustment cap is twisted, said slant guiding surface forces said brush shaft to tilt to a side into said notch so that said brush shaft is reliably and steadily held in a tilted configuration.

2. The bendable mascara brush according to claim 1, wherein said adjustment element is separately joined to or integrally formed with said adjustment cap.

3. The bendable mascara brush according to claim 1, wherein, on interfaces where said adjustment cap is joined to said barrel, corresponding dots and positioning groove engage with each other for rotatably locking said adjustment cap and said barrel together.

4. The bendable mascara brush according to claim 1, wherein one or more ribs are configured around said main shaft so that said main shaft interfaces tightly against the inner wall of said tubular sleeve.

* * * * *